US005542126A

United States Patent [19]

Harvanek

[11] Patent Number: 5,542,126

[45] Date of Patent: Aug. 6, 1996

[54] INSTRUCTIONAL HAND GLOVE

[76] Inventor: Daniel Harvanek, 10840 Park Range Rd., Littleton, Colo. 80127

[21] Appl. No.: 336,175

[22] Filed: Nov. 8, 1994

[51] Int. Cl.[6] ..... A41D 19/00

[52] U.S. Cl. ..... 2/161.2; 2/161.1; 434/252; 273/26 C; 473/202; 473/212

[58] Field of Search ..... 2/159, 160, 161.2, 2/161.3, 161.4, 161.1; 273/26 C, 188 R, 189 R, 187.2, DIG. 30; 434/252

[56] References Cited

U.S. PATENT DOCUMENTS

| | | | |
|---|---|---|---|
| 3,255,462 | 6/1966 | Antonious | 2/161.3 |
| 3,532,344 | 10/1970 | Masstab | 273/DIG. 30 |
| 3,848,874 | 11/1974 | Elkins, Jr. | 2/161.2 |
| 4,000,903 | 1/1977 | Swanson | 2/161.3 |
| 4,665,565 | 5/1987 | Odom | 2/161.3 |
| 4,691,387 | 9/1987 | Lopez | 2/161.3 |
| 5,028,050 | 7/1991 | Freyer | 2/161.3 |
| 5,184,815 | 2/1993 | Maddox | 273/26 C |
| 5,218,719 | 6/1993 | Johnson | 2/161.1 |
| 5,232,225 | 8/1993 | Snyder | 2/161.3 |
| 5,462,280 | 10/1995 | Dickerson | 273/187.2 |

FOREIGN PATENT DOCUMENTS

| | | | |
|---|---|---|---|
| 9407385 | 4/1994 | WIPO | 2/161.2 |

OTHER PUBLICATIONS

Advertisement for "Correct Grip Golf Glove" in Competitive Edge Golf, p. 23, copyright 1995.

Pp. 25–29 of book entitled, "You can Teach Hitting" by Dusty Baker, copyright 1993.

Advertisement for GRIP–TEC (tm) Batting Glove, copyright 1993.

*Primary Examiner*—Michael A. Neas

*Attorney, Agent, or Firm*—Gary M. Polumbus; Holland & Hart LLP

[57] ABSTRACT

A hand glove includes markings formed thereon which, when worn by a wearer, provide the wearer with a visual indication of the proper gripping position of an implement, such as a golf club or a baseball bat. By aligning the implement with markings formed on the hand glove, a proper gripping position of the selected implement can be obtained.

18 Claims, 7 Drawing Sheets

10R
13
14R
18R
20R
22R
23R
24R
25R
26R
28R
30R
52
54
56
58
62
76
80
82

INSTRUCTIONAL HAND GLOVE

BACKGROUND OF THE INVENTION

The present invention relates generally to hand gloves and, more particularly, to an instructional hand glove which, when worn by a wearer, instructs the wearer in the proper hand placement of the wearer's hands about a handle of a staff-shaped implement, such as a golf club or a baseball bat.

Various sporting, and other, activities require a participant to utilize an implement to partake in the activities. For instance, to participate in golfing activities, the participant utilizes a golf club which is used to strike a golf ball. Analogously, in the sport of baseball, a participant swings a baseball bat to strike a baseball. Other types of sporting activities similarly require a participant to utilize other types of staff-shaped implements.

In each of the above-listed activities, the participant is required to grasp the handle of an appropriate implement and to impart some type of motion to the implement. Proper gripping of the handle of the implement is oftentimes essential to permit the successful use of the implement in execution of any of the various activities. Even relatively minor mis-positioning of the user's hand when gripping the handle of the implement can significantly decrease the likelihood of a successful outcome in the execution of any of the various activities.

As proper positioning of the participant's hands about the handle of the implement plays such a significant role in the success of the participant in the activity, instruction and practice in the proper gripping position of the participant's hands plays a significant and beneficial role in the improvement of the participant's skill in the particular activity.

Any means which would facilitate the participant in learning proper gripping positions would advantageously permit the skills of the participant in the particular activities to be improved.

It is with respect to these considerations and other background information that the significant improvements of the present invention have evolved.

SUMMARY OF THE INVENTION

The present invention advantageously provides an instructional hand glove, or a pair of instructional hand gloves, which, when worn by a wearer, provides the wearer with a visual indication of proper hand placement of the wearer's hands about a handle of an implement, such as a golf club or a baseball bat.

The instructional hand glove includes markers visible upon external surfaces of the glove. The markers provide the wearer with the visual indication of the correct positioning of the wearer's hands when gripping the handle of the implement.

The markers visible upon the exterior portions of the hand glove are individualized for the particular implement which is to be gripped by the wearer. For instance, in one embodiment, the instructional hand glove includes markings formed thereupon which instruct the wearer to grip properly a golf club. In another embodiment, the instructional hand glove includes markings formed thereupon to instruct the wearer to grip properly a baseball bat. The instructional hand glove, in other embodiments, may include markings formed thereupon to instruct the user to grip properly other implements.

Because the instructional hand glove, when worn by the wearer, provides a visual indication of the proper positioning of the wearer's hands, the wearer is permitted self-instruction with respect to the wearer's hand positions when gripping the implement.

In accordance with the present invention, therefore, an instructional hand glove worn on a wearer's hand instructs the wearer in proper hand placement of the wearer's hand about a handle of an implement. The instructional hand glove includes a central glove piece having a palm section positioned beneath a palm of the wearer's hand and a top face section positionable upon a top face area of the wearer's hand. A thumb pocket extends radially beyond the central glove piece and includes a thumb-pocket bottom face side and a thumb-pocket top face side wherein the thumb-pocket is positionable about a thumb of the wearer's hand. At least one finger pocket extends radially beyond the central glove piece and has a finger-pocket bottom face side and a finger-pocket top face side. The at least one finger pocket is positionable about at least one finger of the wearer's hand. At least one marking is formed upon at least one of the central glove piece, the thumb pocket, and the at least one finger pocket. The marking provides a visual indication to the wearer of the proper hand placement of the wearer's hand about the handle of the implement.

A more complete appreciation of the present invention and the scope thereof can be obtained from the accompanying drawings which are briefly summarized below, the following detailed description of the presently preferred embodiments of the invention, and the appended claims.

DETAILED DESCRIPTION

Figure 3:
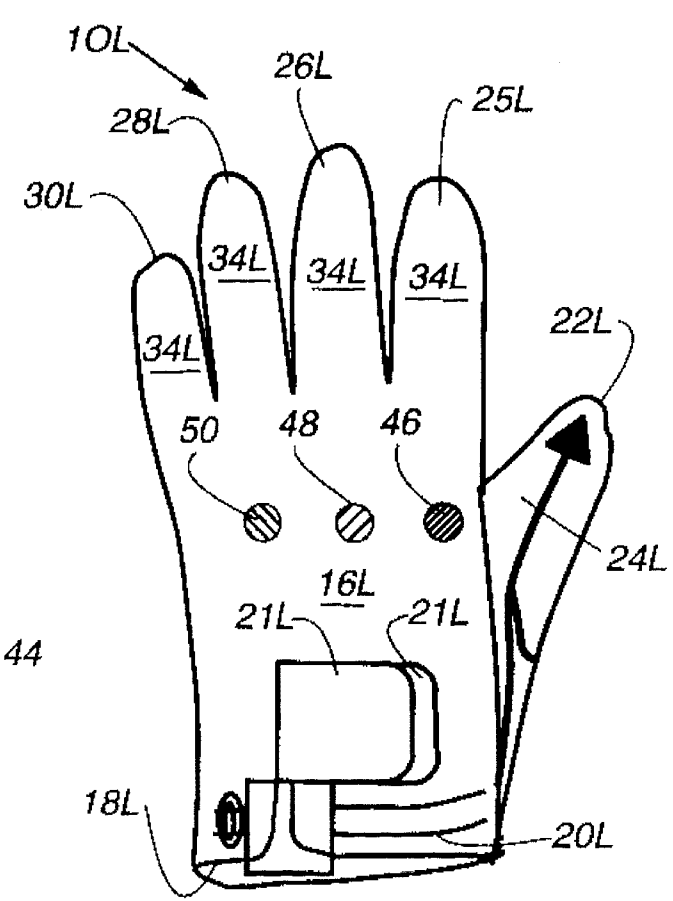
FIG. 3 is an elevational view, taken from above the instructional hand glove shown in FIG. 1.
Figure 2:
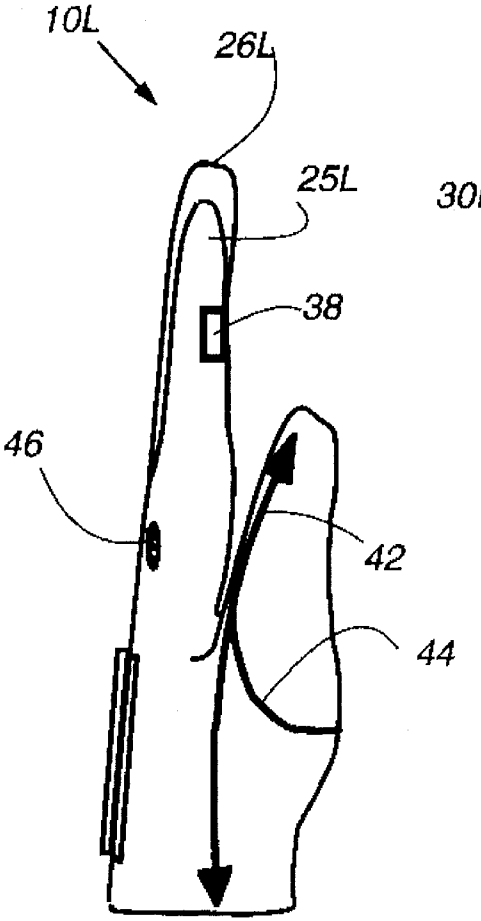
FIG. 2 is a side-elevational view of the instructional hand glove shown in FIG. 1.
Figure 1:
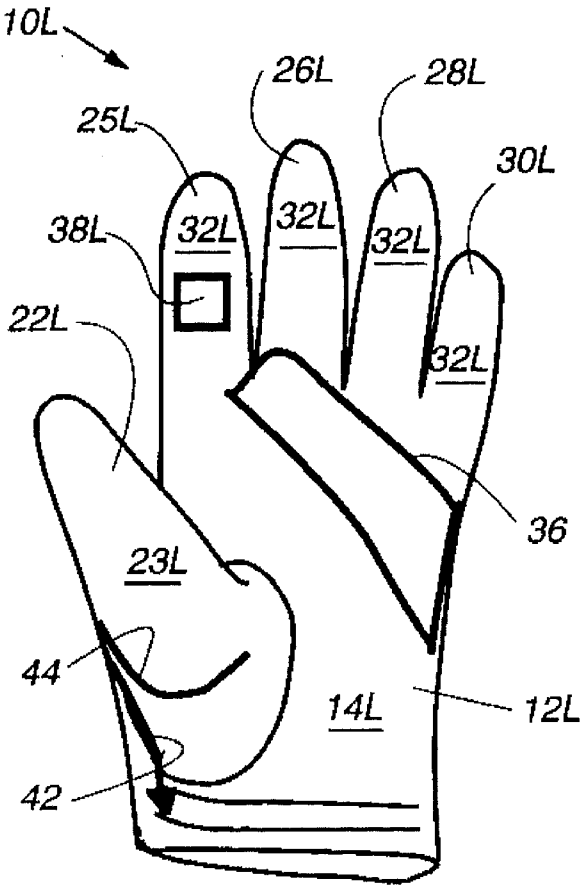
FIG. 1 is an elevational view, taken from beneath an instructional hand glove, here a left-handed hand glove of an embodiment of the present invention.

FIGS. 1–3 illustrate a left-handed embodiment of an instructional hand glove 10L of the present invention. The hand glove 10L may be constructed of any suitable material having an elastic nature, such as a leather material. The hand glove may alternately be constructed of a knitted or woven acrylic material, wool, cotton, spandex (TM) or other suitable material.

The hand glove 10L may be of any desired size to fit comfortably the hand of a wearer. As shall be described below, the hand glove is worn by the wearer to grip the handle of a golf club. A relatively tight-fit of the hand glove about the hand of the wearer facilitates gripping of the handle. Therefore, the hand glove is advantageously, although not necessarily, sized to the hand size of the wearer.

The hand glove 10L includes a central glove piece 12L having a palm portion 14L and a top face section 16L. When the hand glove is worn by a wearer, the palm portion 14L is positioned adjacent to the palm area of the wearer's hand, and the top face section 16L of the central glove piece 12L is positioned adjacent to the back of the hand.

In the embodiment illustrated in FIGS. 1–3, the central glove piece 12L further includes a wrist portion 18L. An elastic band 20L is sewn to the material of the wrist portion 18L of the hand glove 10L. The elastic band 20L is operative to assist in maintaining the hand glove in position upon the wearer's hand.

Velcro (TM) fasteners 21L are positioned upon the top face section 16L of the hand glove 10L. The fasteners 21L may be positioned by the wearer of the hand glove to adjust the fit of the hand glove on the wearer's hand to assist, in conjunction with the elastic band 20L formed about the wrist portion 18L of the hand glove to maintain the hand glove in position on the wearer's hand.

A thumb pocket 22L is sewn to the central glove piece 12L and extends radially outwardly from the central glove piece in a conventional manner. The thumb pocket is positioned about a thumb of the wearer's hand when the hand glove 10L is worn by the wearer. The thumb pocket includes a thumb-pocket bottom face side 23L and a thumb-pocket top face side 24L.

The hand glove 10L further includes finger pockets 25L, 26L, 28L and 30L. The finger pockets 25L–30L extend radially outwardly from the central glove piece 12L in conventional fashion and each of the finger pockets includes a bottom face side 32L and a top-face side 34L. When the hand glove is worn by the wearer, the finger pockets are positioned about the fingers of the wearer's hand.

An angularly-extending marking forming a palm piece 36 is formed on the palm portion 14L of the hand glove 10L. The palm piece extends diagonally from a side of the palm portion to the base of the finger portions 25L and 26L. In one embodiment, the angularly-extending palm piece 36 is formed from a dye applied to the palm portion 14L. In another embodiment, the palm piece is cut from a sheet of material, such as a leather material, and sewn to the palm portion. The palm piece 36, when formed of the separate material, may also be glued to the palm portion. The palm piece is preferably of a color which is dissimilar to the color of the palm portion 14L. For instance, if the central glove piece 12L is formed of a white leather material, the palm piece may be of a blue color to provide a visual contrast between the central glove piece and the palm piece.

A finger tab 38 is formed upon the bottom-face side 32L of the finger pocket 25L. Similar to the palm piece 36, the finger tab 38 may be formed either by application of an appropriate dye to the finger pocket 25L or a separate material piece may be sewn to the finger pocket. Again, the finger tab is preferably of a color which is dissimilar to the color of the finger pocket. For instance, if the finger pockets are formed of a white leather material, the finger tab may be of a blue color, similar to the color of the palm piece 36.

A curved arrow section 42 extends generally longitudinally along the thumb pocket 22L of the hand glove 10L. In the embodiment illustrated in FIGS. 1–3, the curved arrow section extends into the wrist portion 18L of the glove. A somewhat transversely-extending arcuate lead section 44 to the arrow section 42 is also formed upon the thumb pocket 22L. The arcuate lead section 44 intersects with the curved arrow section 42 at approximately a midpoint along the length of the curved arrow section.

The curved arrow section 42 and arcuate lead section 44 are, similar to the finger tab 38 and palm piece 36, formed of dye markings applied to the thumb pocket 22L or may be a separate material piece sewn or otherwise affixed to the thumb pocket. The sections 42 and 44 are again preferably of a color dissimilar from the color of the thumb pocket.

Grip-type markers 46, 48, and 50 are formed upon the top face section 16L of the central glove piece 12L of the hand glove 10L. The grip-type markers are positioned transversely across the top face section at spaced intervals. The grip-type markers may be formed with a dye or may be formed with a separate piece of material sewn or glued to the top face section 16L.

In one arrangement of the present invention, circular apertures may be formed in the top face section 16L of the glove and material pieces corresponding to the grip-type markers 46, 48 and 50 are inserted into the apertures. The material pieces are then sewn to the face section so as to be visible through the apertures. In this arrangement, the markers 46, 48 and 50 are disposed beneath the surface level of the top face section 16L.

Figure 6:
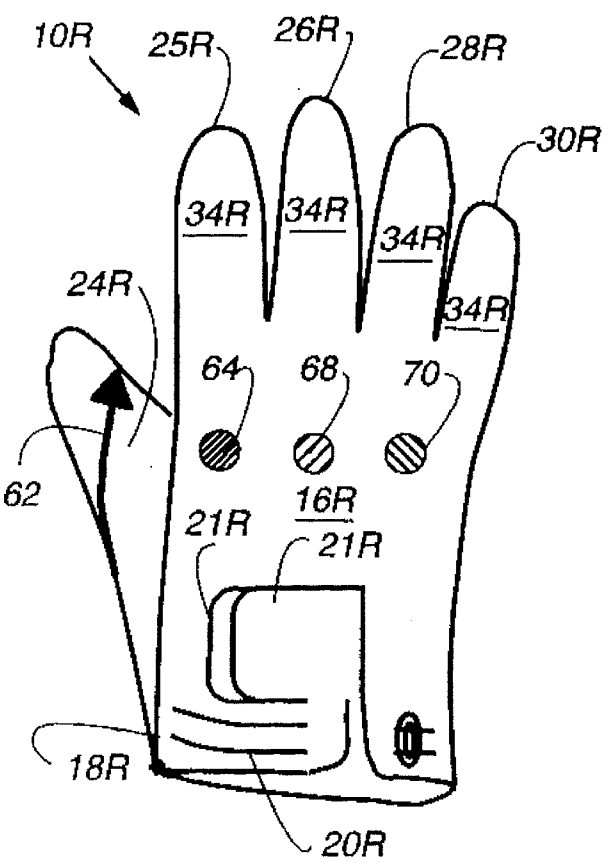
FIG. 6 is an elevational view, taken above the instructional hand glove shown in FIG. 4.
Figure 5:
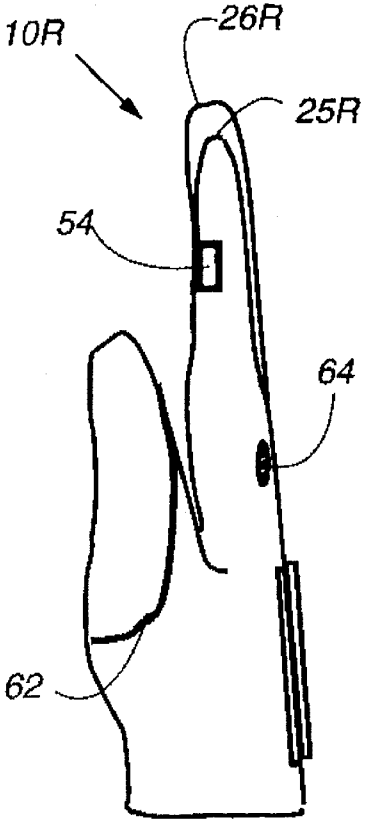
FIG. 5 is a side-elevational view of the instructional hand glove shown in FIG. 4.
Figure 4:
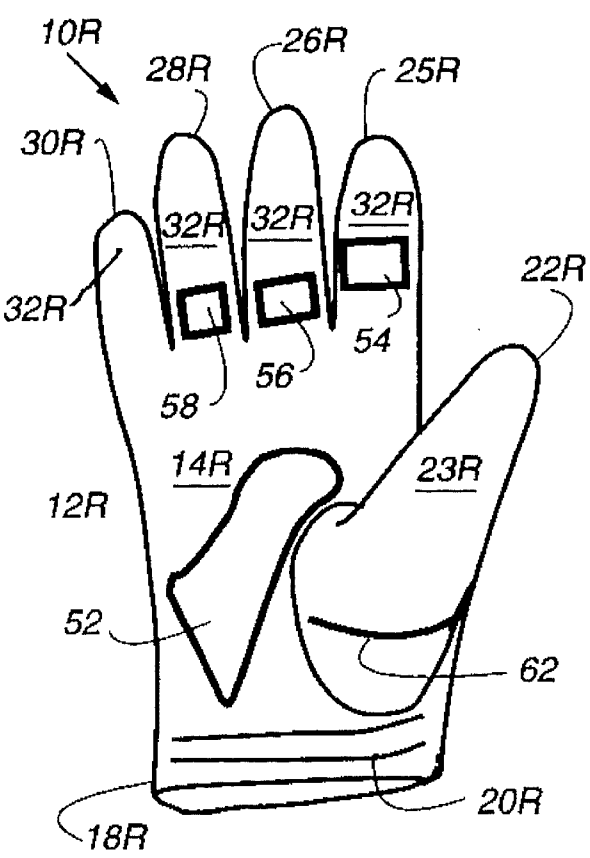
FIG. 4 is an elevational view, taken from beneath an instructional hand glove, here a right-handed, instructional hand glove of an embodiment of the present invention.

FIGS. 4–6 illustrate a right-handed instructional hand glove 10R of the present invention. The hand glove 10R, similar to the hand glove 10L, may be constructed of any suitable material, such as any of the materials of which the hand glove 10L may be constructed. The hand glove 10R may also be of any desired size to fit comfortably upon a hand of a wearer, also preferably sized to fit the hand size of the wearer.

The hand glove 10R includes a central glove piece 12R having a palm portion 14R and a top face section 16R. When the hand glove 10R is worn by a wearer, the palm portion is positioned adjacent to the palm area of the wearer's hand, and the top face section 16R is positioned adjacent to the back of the wearer's hand.

In the embodiment illustrated in FIGS. 4–6, the central glove piece 12R further includes a wrist portion 18R. An elastic band 20R is sewn to the material of the wrist portion. The elastic band is operative to assist in maintaining the hand glove 10R in position upon the wearer's hand when worn by the wearer.

Velcro (TM) fasteners 21R are also positioned upon the top face section 16R of the hand glove 10R. The fasteners may be positioned by the wearer of the hand glove to adjust the width of the hand glove and/or to assist, in conjunction with the elastic band 20L, in maintaining the hand glove in position upon the wearer's hand.

A thumb pocket 22R is sewn to the central glove piece 12R and extends radially outwardly from the central glove piece in a conventional manner. When the hand glove is worn by a wearer, the thumb pocket is positioned about the thumb of the wearer's hand. The thumb pocket includes a thumb pocket bottom face side 23R and a thumb pocket top face side 24R.

The hand glove 10R further includes finger pockets 25R, 26R, 28R, and 30R. The finger pockets extend radially outwardly from the central glove piece 12R in a conventional manner. Each of the finger pockets include a bottom face side 32R and a top face side 34R. When the hand glove is worn by a wearer, the finger pockets are positioned about the fingers of the wearer's hand.

A diagonally or angularly-extending marking forms a palm piece 52 upon the palm portion 14R of the central glove piece 12R. The angularly-extending palm piece 52 extends diagonally from a side of the palm portion 14R along the palm portion 14R to a location above the connection of the thumb pocket 22R with the central glove piece 22R. Similar to the palm piece 36 and finger tab 38 of the hand glove 10L, the palm piece 52 may be formed from a dye or may be a separate material sewn or glued to the palm portion of the central glove piece. The palm piece is of a color which is preferably dissimilar from the color of the palm portion 14R of the central glove piece 12R. Again, for example, if the central glove piece is formed of a white leather material, the palm piece may be of a blue color to provide a visual contrast between the glove piece and the palm piece.

Finger tabs 54, 56 and 58 are formed upon the bottom-face surfaces 32R of the finger pockets 25R, 26R and 28R, respectively. The finger tabs may be formed of either dye markings formed upon the bottom-face surfaces 32R or may be formed from material pieces which are sewn or otherwise affixed to the bottom-face surfaces. The finger tab 54 is slightly offset relative to the placement of the finger tabs 56 and 58 upon their respective finger pockets. The finger tabs are preferably of colors which are dissimilar from the colors of the finger pockets. If the finger pockets are formed of a white leather material, the finger tabs may be of a blue color, similar to the color of the palm piece 52.

An curved arrow section 62 is formed upon the thumb pocket 22R of the hand glove 10R. The curved arrow section extends generally longitudinally of the thumb pocket along both the bottom face surface 23R and the top face surface 24R of the thumb pocket. Again, the curved arrow section may be formed of a dye material or a separate piece of material sewn or glued to the thumb pocket.

Grip-type markers 64, 68 and 70 are formed upon the top face section 16R of the central glove piece 12R of the hand glove 10R. The grip-type markers are positioned transversely across the top face section at spaced intervals. The grip-type markers may again be formed of a dye material or be formed of a separate piece of material sewn or glued to the top face section 16R. The markers may also be positioned in apertures as with the hand glove 10L described previously.

FIG. 7 illustrates again the hand glove 10L shown in FIGS. 1–3. The illustration of FIG. 7 further shows a phantom line segment 74 extending along the length of the angularly-extending palm piece 36 and across the finger tab 38. The phantom line segment 74 highlights the spatial relationship between the palm piece 36 and the finger tab 38. Namely, the palm piece 36 and the finger tab 38 are aligned with one another in a linear relationship defined by the phantom line segment 74 extending angularly across the hand glove 10L.

Figures 7, 8, 9:
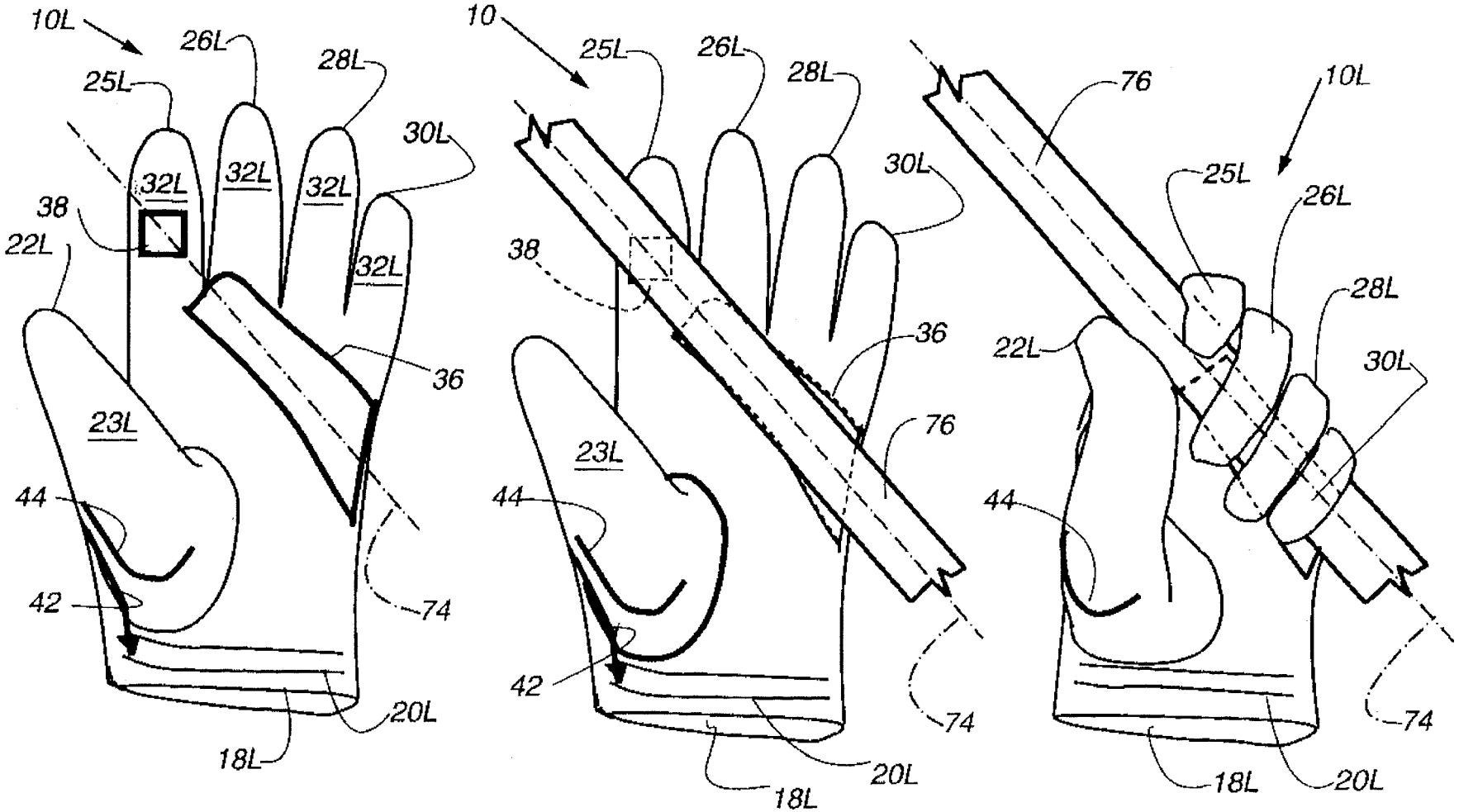
FIG. 7 is an elevational view, similar to that shown in FIG. 3, which illustrates the relationship between a finger tab and a palm piece forming a portion of the instructional hand glove shown in FIGS. 1–3.
FIG. 8 is an elevational view, similar to that shown in FIG. 7, but which illustrates the positioning of a portion of a handle of a golf club when initially positioned together with the instructional hand glove shown in FIGS. 1–3.
FIG. 9 is an elevational view, similar to that shown in FIG. 8, but which illustrates the relationship between the handle of the golf club and the instructional hand glove when a wearer of the hand glove properly grips the handle of the golf club.

FIG. 8 illustrates the hand glove 10L together with a portion of a club handle 76 of a golf club. The club handle 76 of the golf club extends axially along the phantom line segment 74.

In order to properly grip the club handle 76, the club handle is initially positioned in the palm area of a holder's left hand. In FIG. 8, the wearer of the hand glove 10L positions the club handle 76 across the hand glove such that the club handle rests upon the palm piece 36 and the finger tab 38. By positioning the club handle 76 in the manner illustrated, proper initial positioning of the club handle 76 in the left hand of the wearer is assured. Proper gripping of the club handle by the wearer of the hand glove 10L is facilitated by proper initial positioning of the club handle 76 in the manner illustrated.

FIG. 9 illustrates again the hand glove 10L and the portion of the club handle 76 of a golf club when the club handle 76 is gripped properly by the left hand of a holder of the club handle 76. The holder's left-hand fingers are wrapped about the club handle 76 and the holder's left thumb is positioned against the club handle 76, all in the correct and desired manner.

FIG. 10 again illustrates the right-handed hand glove 10R shown in FIGS. 4–6. Phantom line segments 80 and 82 are also illustrated in the figure. The phantom line segment 80 extends across the finger tabs 54, 56, and 58 to indicate the relationship between the finger tabs. The phantom line segment 82 extends through the angularly-extending palm piece 52 along a longitudinal axis defined by the palm piece 52. The line segments 80 and 82 intersect just beyond the hand glove 10R in the illustration of FIG. 10.

Figures 10, 11, 12, 13:
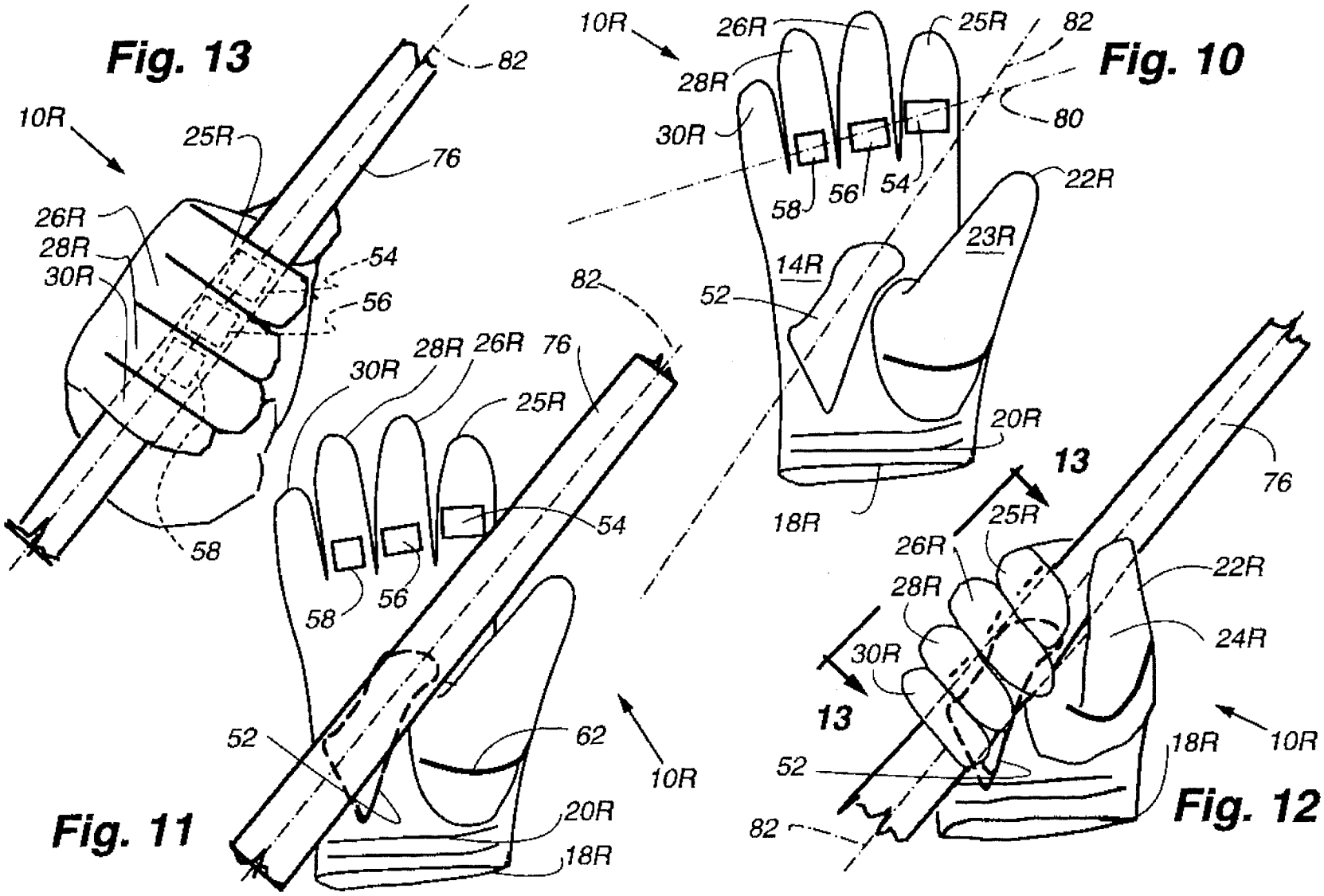
FIG. 10 is an elevational view, similar to that shown in FIG. 4, which illustrates the relationship between the finger tabs and a palm piece of the right-handed instructional hand glove shown in FIGS. 4–6.
FIG. 11 is an elevational view, similar to that shown in FIG. 10 but which illustrates a portion of a handle of a golf club when initially positioned against the right-handed instructional glove.
FIG. 12 is an elevational view, similar to that of FIG. 11, but which illustrates the relationship between the handle of the golf club and the instructional hand glove when a wearer of the hand glove grips the handle of the golf club.
FIG. 13 is an elevational view, similar to that shown in FIG. 12, but taken from the direction indicated by lines 13—13 shown in FIG. 12.

FIG. 11 also illustrates the right-handed hand glove 10R shown in FIGS. 4–6 and 10. Here, the hand-glove 10R is positioned together with the club handle 76 of a golf club. As illustrated in the figure, the club handle 76 of the golf club is positioned to extend axially in a direction defined by the phantom line segment 82, also shown previously in FIG. 10. In order to properly grip the club handle 76, the club handle, prior to gripping of the handle 76, must be positioned in the palm area of the holder's right hand. In FIG. 11, the wearer of the hand glove positions the club handle 76 across the hand glove such that the club handle rests upon the palm piece 52. By positioning the club handle in the manner illustrated, proper initial positioning of the club handle 76 in the right hand of the hand glove 10R is assured. Proper gripping of the club handle by the wearer of the hand glove 10R is facilitated by proper initial positioning of the club handle 76 in the manner illustrated. By placing the club handle 76 to extend longitudinally along the palm piece 52, the holder of the club handle 76 is assured of proper initial positioning of the club handle of the golf club in the holder's right hand.

FIG. 12 again illustrates the right-handed hand glove 10R and the club handle 76 of the golf club, here when the holder of the club handle 76 properly grips the club handle 76 with the holder's right hand. As illustrated, the holder's right-hand fingers are curved about the club handle 76 and the holder's right thumb is positioned against the club handle 76.

FIG. 13 also illustrates the right-handed hand glove 10R and the club handle 76 when the holder grips the club handle 76 with the holder's right hand. The illustration of FIG. 13 is taken from a different orientation relative to the illustration of FIG. 12 and illustrates in hidden lines the positioning of the finger tabs 54, 56 and 58 relative to the club handle 76 when the holder grips the club handle 76. As illustrated, when the holder's fingers are curved about the club handle 76 to grip the club handle, each of the three finger tabs are positioned in an aligned relationship to extend along the club handle 76. Thus, by properly orienting the club handle relative to the palm piece 52 and the finger tabs formed upon the hand glove, the holder of the club handle is assured of proper gripping of the club handle 76 by the holder's right hand.

It is to be understood that in reality, the left hand is first properly positioned on the golf club handle as described and subsequently the right hand is positioned. Typically the right hand will partially overlap the left in a conventional "Vardon" grip well known in the game of golf.

Figure 14:
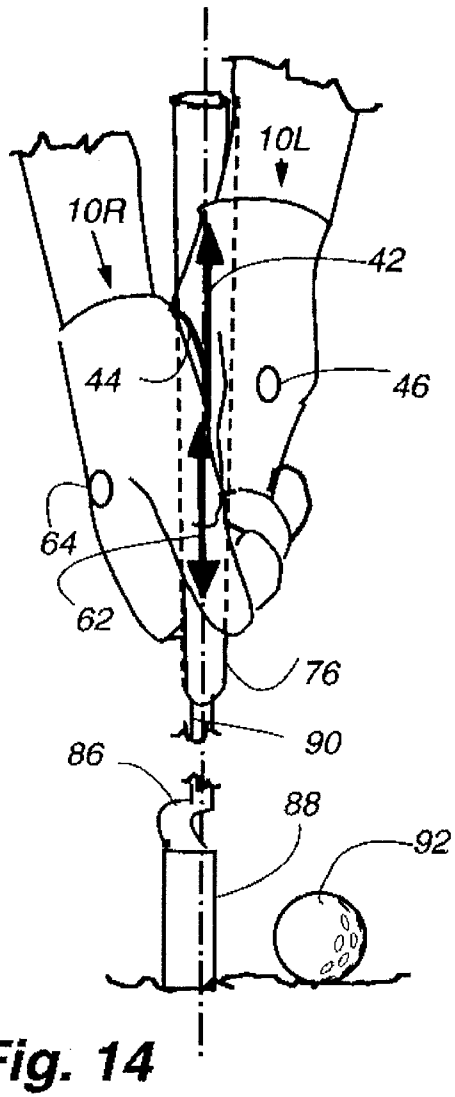
FIG. 14 is a perspective illustration of a wearer of the hand gloves shown in FIGS. 1–3 and 4–6 gripping a golf club in a first gripping position.

FIG. 14 illustrates both hand gloves 10L and 10R worn by a holder of the club handle 76 of a golf club 86. The golf club includes, in addition to the club handle 76, a club head 88 and a club shaft 90. The holder of the golf club is here illustrated to be addressing a golf ball 92 in preparation of a straight golf shot. To hit a straight shot, the club handle of the golf club 86 is gripped in FIG. 14.

When the club handle 76 is properly gripped, as illustrated in FIG. 14, the curved arrow section 42 formed upon the thumb pocket 22L of the left-handed hand glove 10L is aligned with the curved arrow section 62 formed upon the thumb pocket 22R or the right-handed glove 10R. Both curved arrow sections 42 and 62 are aligned with a central longitudinal axis of the club shaft 90 and extend along the club shaft on top of the shaft 90. That is to say, portions of the curved section 62 and the curved section 42 together extend longitudinally along the club handle 76 of the golf club 86 in the axial direction of the club handle 76. The arcuate lead section 44 is positioned to define the location on the left hand for placement of the padded area at the base of the right thumb when the holder of the golf club 86 grips the club handle 76 in the manner illustrated in FIG. 14.

It should also be noted that only the grip-type markers 46 and 64 are visible to the wearer of the gloves when the hands are positioned as illustrated in FIG. 14. When the holder of the golf club 86 grips the club handle 76 to address the golf ball 92 in anticipation of shooting a straight shot, only the grip-type markers 46 and 64 are visible to assure the holder that the hands are properly placed on the club.

The fact that the holder of the golf club 86 can see only the markers 46 and 64, can see that the right thumb pad is positioned along lead section 44 and that arrow sections 42 and 62 are straight and aligned, assures the holder that the hands are properly positioned on the club. If the arrow sections 42 and 62 are not straight or are out of alignment, or if the markers 46 and 64 cannot be seen or other markers can be seen, or if the right thumb pad does not follow lead section 44, the holder of the golf club 86 can alter the grip position, as necessary. In this manner, the holder of the golf club 86 can be assured that the holder's hands are in a proper grip position to address the golf ball 92 to hit a straight shot.

Figure 15:
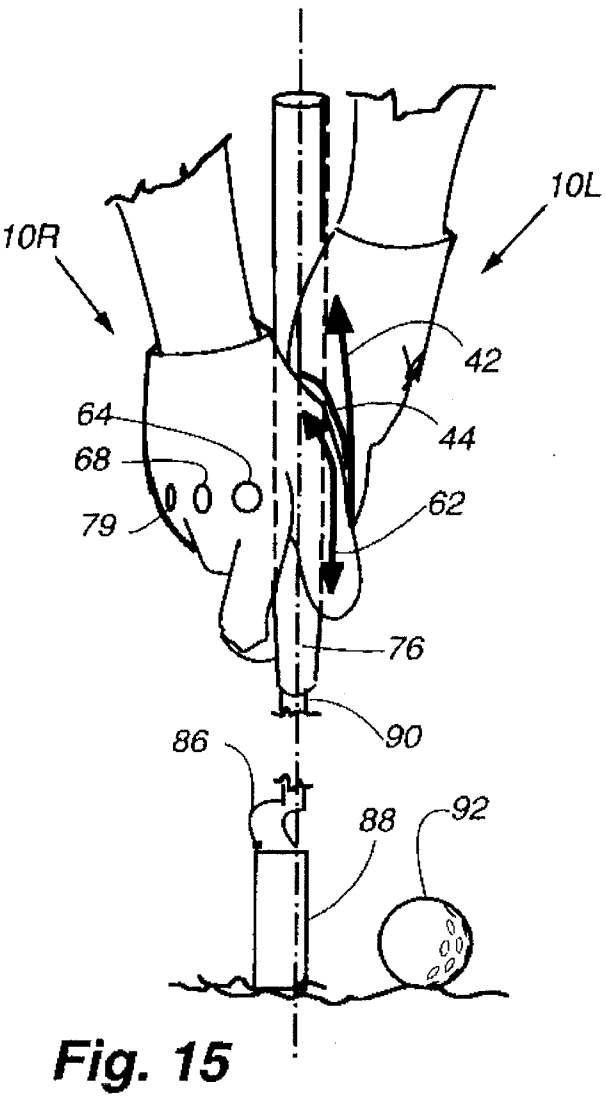
FIG. 15 is a perspective view, similar to that shown in FIG. 14, but which illustrates a wearer of the hand gloves gripping the golf club in a second gripping position.

FIG. 15 is an illustration, similar to that of FIG. 14, but wherein the holder of the golf club 86 grips the club handle 76 in a slightly different orientation. Here, the club handle 76 is gripped by the holder of the golf club 86 to address the ball 92 in preparation for a sliced shot or to establish a "weak" grip as commonly referenced in the game. When the holder grips the club handle of the golf club as shown in FIG. 15, there is a greater tendency for the ball to "slice" or curve in flight to the right. It will be appreciated that the hands of the holder are positioned relative to each other the same as they are in FIG. 14 but are rotated as a unit slightly to the left. Dependent upon the degree of rotation to the left, the holder will see two or more of the markers 64, 68 and 70 on the right glove and none of the markers 46, 48 or 50 on the left glove. The markers are therefore used to determine the degree to which the hands are rotated as a unit relative to the shaft of the golf club.

Figure 16:
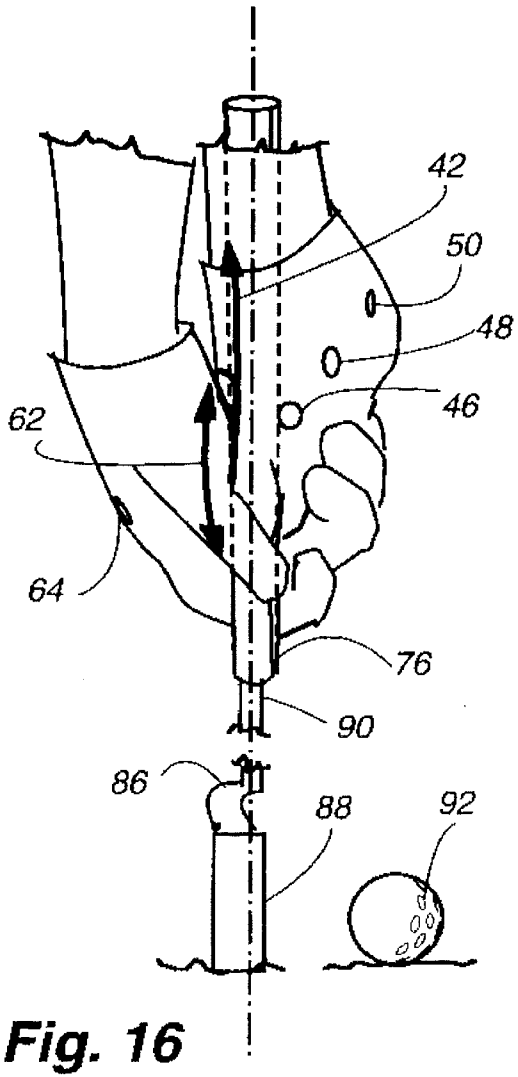
FIG. 16 is a perspective illustration, similar to those shown in FIGS. 14 and 15, but which illustrates the wearer of the hand gloves gripping a golf club in a third gripping position.

FIG. 16 is an illustration, similar to those of FIGS. 14 and 15, but wherein the holder of the golf club 86 grips the club handle 76 in another slightly different orientation. Here, the club handle 76 is gripped by the holder of the golf ball 86 to address the ball 92 in preparation for a "hooked" shot or to establish a "strong" grip as commonly referenced in the game. When the holder grips the club handle of the golf club as shown in FIG. 16, there is a greater tendency for the ball to "hook" or curve in flight to the left. It will be appreciated that the hands of the holder are positioned relative to each other the same as they are in FIGS. 14 and 15 but are rotated as a unit slightly to the right. Depending upon the degree of rotation to the right, the holder will see two or more of the markers 46, 48 and 50 on the left glove and none of the markers 64, 68, and 70 on the right glove. The markers are therefore used to determine the degree to which the hands are rotated as a unit relative to the shaft of the golf club.

When the holder of the golf club 86 desires to shoot a "slice shot," the holder grips the club handle 76 in the manner illustrated in FIG. 15. The curve sections 42 and 62 are positioned to extend along a side of the club handle 76 in the manner illustrated in the figure, thereby to be ensured of properly gripping the club handle 76 to generate the "slice shot."

By repeated iterations of gripping the club handle 76 of the golf club 86 in manners illustrated in FIGS. 14–16, proper gripping positions of the holder's hands becomes automatic and the skill of the participant increases. The participant may practice the various gripping positions without the necessity of a separate instructor and, hence, is able to practice the various gripping positions of the club handle 76 whenever desired.

It may be observed that the hand gloves 10L and 10R shown in the preceding figures facilitate proper gripping of the golf club 86 for a right-handed golf swing. The hand gloves could alternately be formed to facilitate a left-handed golf swing merely by reversing the markings formed on the respective gloves.

Figure 18:
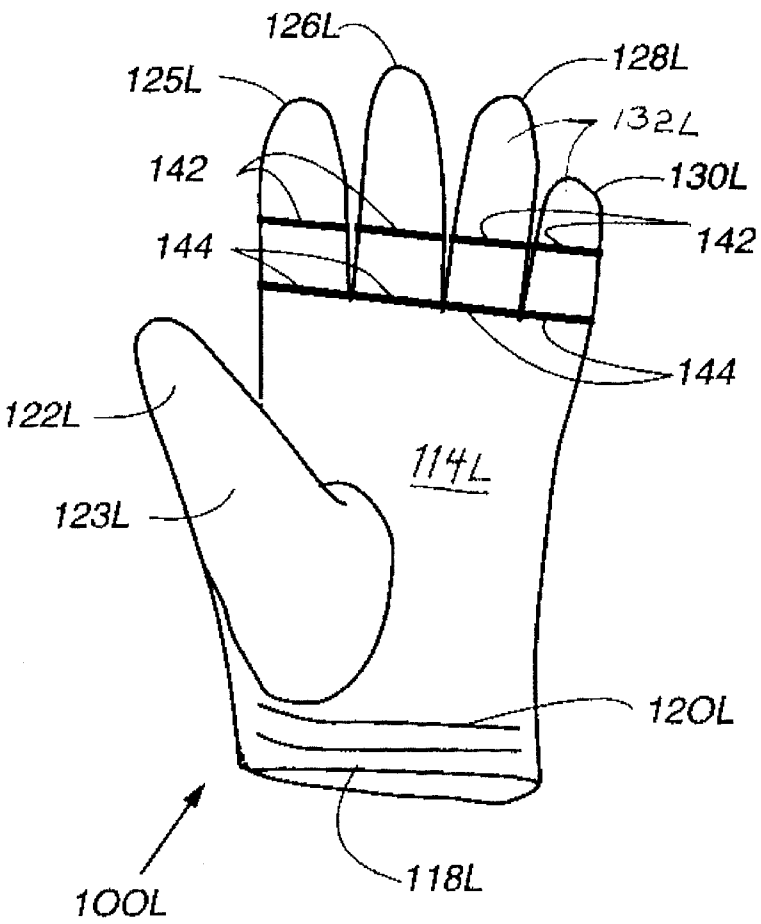
FIG. 18 is an elevational view, similar to that shown in FIG. 17, but taken beneath the instructional hand glove.
Figure 17:
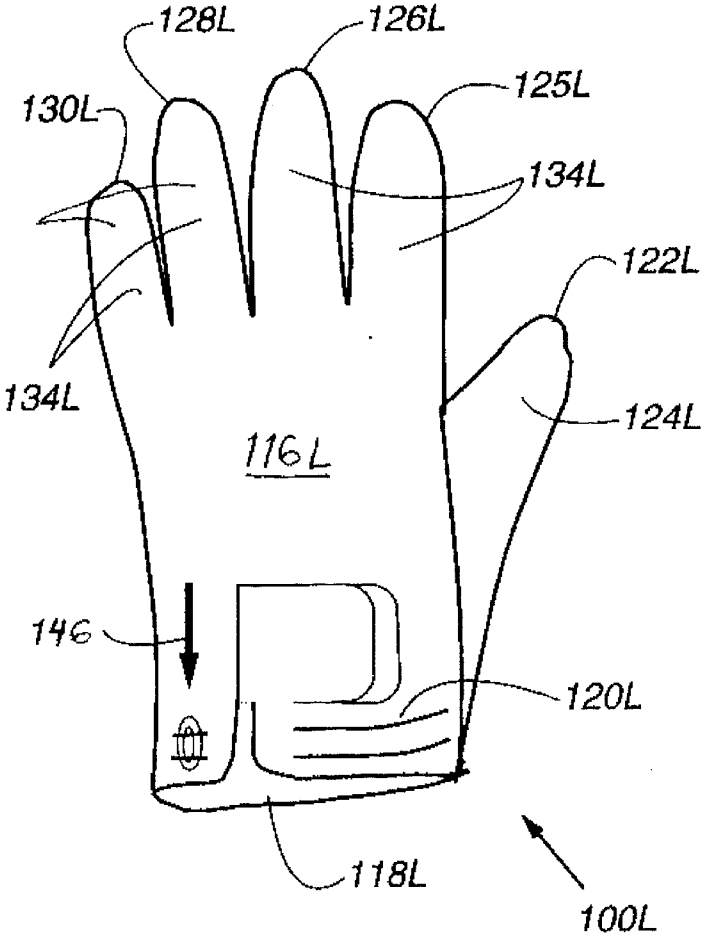
FIG. 17 is an elevational view, taken from above a left-hand instructional glove of an embodiment of the present invention forming a baseball batting glove.

FIGS. 17–18 illustrate a left-handed hand glove, shown generally at 110L, of another embodiment of the present invention useful in training for batting baseballs. Analogous to the left-handed hand glove 10L shown in preceding figures, the hand glove 110L includes a central glove piece 112L which defines a palm portion 114L and a top face section 116L. The central glove piece extends to a wrist portion 118L about which an elastic band 120L is sewn or otherwise affixed. The elastic band assists in maintaining the hand glove in position upon the wearer's hand during use of the hand glove.

A thumb pocket 122L extends outwardly from the central glove piece 112L and defines a thumb pocket bottom side 123L and a thumb pocket top face side 124L. A plurality of finger pockets 125L, 126L, 128L, and 130L also project outwardly from the central glove piece. When the hand glove is worn by a wearer, the thumb pocket is positioned about a left-hand thumb of the wearer, and the finger pockets are positioned about the left-hand fingers of the wearer. The hand glove may be formed of any of the materials of which the hand gloves 10L or 10R, previously described, may be formed.

A first series of transversely extending line segments 142 are formed across the finger pockets 125L–130L. The line segments 142 are formed at locations across the respective finger pockets 125L–130L in a manner together to form a transversely extending line across the finger pockets. A second plurality of line segments, line segments 144, are positioned transversely across the finger pockets of the hand glove 110L. The line segments 144 are also formed upon the finger pockets in a manner together to form a transversely-extending line across the finger pockets.

The line segments 142 are formed across the finger pockets at locations along the lengths of the finger pockets corresponding to the locations at which the wearer's outer knuckles are positioned when the wearer wears the hand glove 110L. And, the line segments 144 are located near the bases of the finger pockets 125L–130L at the locations of the inner knuckles of the hand of a wearer of the hand glove when the hand glove is worn by the wearer. The top face side 116L of the central glove section 112L includes an arrowed segment 146. The arrowed segment extends longitudinally along the top face section of the hand glove.

The line segments 142 and 144 and the arrowed segment 146 can be formed upon the hand glove 110L either by dye markings or may be sewn or otherwise affixed to the hand glove.

Figure 20:
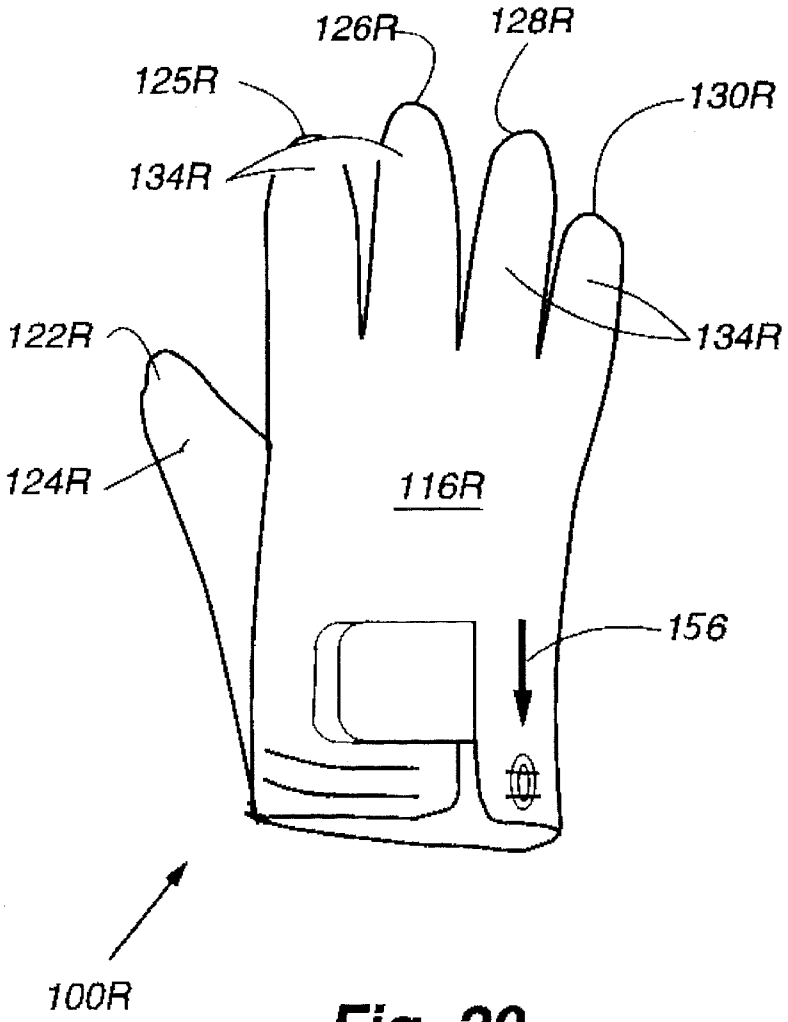
FIG. 20 is an elevational view, similar to that shown in FIG. 19 but taken from above the instructional hand glove.
Figure 19:
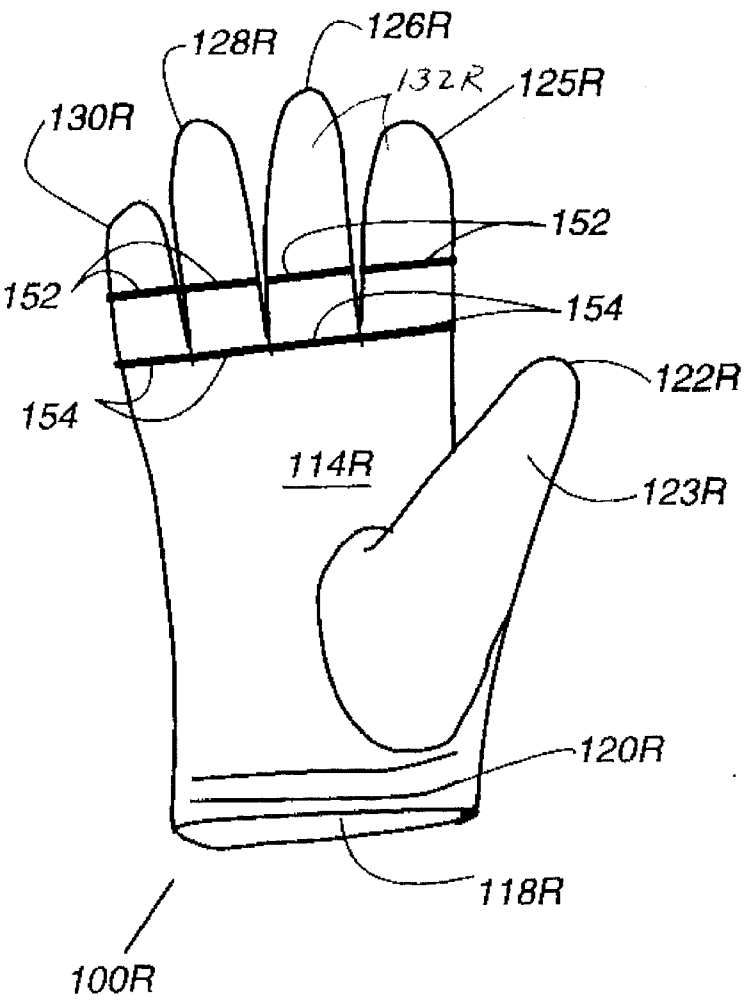
FIG. 19 is an elevational view, taken from beneath, a right-hand, instructional hand glove of an embodiment of the present invention forming a baseball batting glove.

A corresponding, right-handed hand glove, shown generally at 110R, of an embodiment of the present invention is shown in FIGS. 19 and 20. The hand glove 110R includes a central glove section 112R, which extends to a wrist portion 118R having an elastic band 120R sewn thereabout to assist in maintaining the hand glove 110R on the hand of a wearer.

A thumb pocket 122R extends outwardly from the central glove piece 112R and includes a bottom face side 123R and a top face side 124R.

A plurality of finger pockets, finger pockets 125R, 126R, 128R, and 130R also extend outwardly from the central glove piece 112R, in conventional manner. The thumb pocket 122R is positioned about the thumb of a wearer, and the finger pockets are positioned about the fingers of a wearer, when the hand glove is worn upon the right-hand of the wearer.

Analogous to the line segments 142 extending across the finger pockets 125L–130L, a plurality of line segments 152 are positioned across the finger pockets 125R–132R. And, analogous to the line segments 144 shown in FIG. 17, the hand glove 110R includes a plurality of transversely-extending line segments 154 which extend across the finger pockets 125R–130R. The line segments 152 together form a line extending transversely across the finger pockets, and the line segments 154 together define a transversely extending line across the finger pockets.

An arrowed segment 156 is formed upon the top face section 116R of the central glove section 112R. The arrowed segment 156 extends longitudinally along a portion of the top face section.

Again, the line segments 152 and 154 and the arrowed segment 156 may be formed either by application of an appropriate dye material upon the hand glove or by sewing a separate material piece upon the hand glove.

The hand gloves 110L and 110R are together worn by a wearer to facilitate proper gripping of a bat handle of a baseball bat in either of three grip positions, a standard grip position, a modified standard grip position, and a choke grip position.

Once the hand gloves 110L and 110R are placed upon the hands of a wearer, the wearer then places a baseball bat to extend longitudinally along the segments 142, 144, 152, and 154 formed upon the hand gloves. Depending upon the type of grip desired, however, a desired one of the line segments 142 and 144 and desired one of the line segments 152 and 154 are positioned beneath a longitudinal axis of the baseball bat. The wearer of the hand gloves positions the wearer's hands one above the other about the bat.

When a standard grip is desired, the line segments 142 of the left-handed hand glove 110L are aligned with the longitudinal axis of the baseball bat and the line segments 152 of the right-handed hand glove 110R are aligned with the longitudinal axis of the baseball bat.

The wearer's hands are otherwise aligned in conventional fashion for a right-handed batter or a left-handed batter, as desired.

When a choke batting grip is desired, the line segments 144 and 154 are aligned with the longitudinal axis of the baseball bat.

And, when a modified batting grip is desired, the batter is a right-handed batter, the line segments 144 are aligned with the longitudinal axis of the baseball bat and the line segments 152 are aligned with the longitudinal axis of the baseball bat. When the wearer of the gloves is a left-handed batter, the line segments 154 are aligned with the longitudinal axis of the baseball bat and the line segments 142 are aligned with the longitudinal axis of the baseball bat.

Thus, when the wearer of the hand gloves 110L and 110R properly aligns the line segments 142 or 144 and the line segments 152 and 154 with a longitudinal axis of a baseball bat, a desired gripping position of the baseball bat can be obtained.

The arrowed segments 146 and 156 formed on the top face sections 116L and 116R provide a visual indication of the field to which a batted ball is intended to be hit.

When a wearer of the handgloves 110L and 110R is positioned at a batting plate, the batter orients the baseball bat relative to a pitched ball. To increase the chances of hitting the pitched ball to a particular area of a playing field, the wearer orients the baseball bat to direct one of the arrowed segments to the desired particular area. A right-handed batter wearing the gloves 110L and 110R directs the arrowed segment 146 towards the desired particular area of the playing field. A left-handed batter wearing the gloves directs the arrowed segment 156 towards the desired particular area of the playing field.

The hand gloves disclosed and described in the preceding description provide a wearer with a visual indication of proper gripping positions of the wearer's hands when gripping a golf club or a baseball bat. By wearing the hand gloves, the wearer is permitted self instruction in the proper gripping positions. The teachings of the present invention can, similarly, be utilized to permit the wearer instruction in the proper gripping position of other implements, such as the rackets used in racket sports and utilitarian implements, for instance, a broom. By the formation of appropriate markings on hand gloves, proper gripping positions for any of many desired implements can be created.

Presently preferred embodiments of the present invention and many of its improvements have been described with a degree of particularity. The previous descriptions are of preferred examples for implementing the invention, and the scope of the invention should not necessarily be limited by this description. The scope of the present invention is defined by the following claims.

We claim:

1. An instructional hand glove worn on a wearer's hand to instruct the wearer in proper hand placement of the hand of the wearer about a handle of an implement, said instructional hand glove comprising:

a central glove piece having a palm section positionable adjacent to the palm of the wearer's hand and a top face section positionable adjacent to the back of the wearer's hand;

a thumb pocket extending substantially radially beyond said central glove piece, said thumb pocket positionable about a thumb of the wearer's hand; and curved markings formed upon said thumb pocket including an arrowed marking extending longitudinally along said thumb pocket and a transversely-extending arcuate marking intersecting the arrowed marking, said curved markings for providing a visual indication to the wearer of the proper hand placement of the wearer's hand about the handle of the implement.

2. The instructional hand glove of claim 1 wherein said curved markings comprises a dye material painted upon said thumb pocket.

3. The instructional hand glove of claim 1 wherein said curved markings comprises a material piece affixed upon said thumb pocket.

4. The instructional hand glove of claim 1 wherein the implement comprises a golf club and wherein said curved markings provides a visual indication to the wearer of the proper hand placement of the wearer's hand about the handle of the golf club.

5. The instructional hand glove of claim 4 wherein said central glove piece further comprises an angularly-extending palm piece marking positioned upon the palm section of said central glove piece, said palm piece marking positioned to abut against a hand-length of the handle of the golf club when the user's hand is placed upon the handle in a proper position.

6. The instructional hand glove of claim 4 wherein the instructional hand glove further comprises at least one finger pocket extending radially beyond said central glove piece, said at least one finger pocket positionable about at least one finger of the wearer's hand; and a finger tab formed upon said at least one finger pocket said finger tab positioned to abut against the handle of the golf club when the wearer's hand is placed about the handle of the golf club in a proper position.

7. The instructional hand glove of claim 4 wherein the instructional hand glove further comprises two adjacently positioned finger pockets extending radially beyond said central glove piece, said finger pockets positionable about at least two fingers of the wearer's hand; and a finger marking formed upon the two adjacently-positioned finger pockets and positioned to abut against the handle when in a proper position.

8. The instructional hand glove of claim 4 wherein said curved markings formed upon said thumb pocket are positioned to extend axially along the handle of the golf club when the wearer's hand is placed on the handle in a proper position.

9. The instructional hand glove of claim 4 wherein said central glove piece further includes a first grip-type marker positioned upon the top face section of said central glove piece, said first grip-type marker being in a predetermined position for viewing by the wearer to indicate a proper position of the hand on the golf club.

10. The instructional hand glove of claim 9 wherein said central glove piece further includes a second grip-type marker positioned upon the top face section of said central glove piece and spaced-apart from said first grip-type marker.

11. The instructional hand glove of claim 10 wherein said central glove piece further includes a third grip-type marker positioned upon the top face section of said central glove piece and spaced apart from the second grip-type marker.

12. The instructional hand glove of claim 1 wherein the implement comprises a bat and wherein said curved markings provides a visual indication to the wearer of the proper hand placement of the wearer's hand on the bat.

13. The instructional hand glove of claim 12 wherein the instructional hand glove further includes at least one finger pocket extending radially beyond said central glove piece, said at least one finger pocket positionable about at least one finger of the wearer's hand and having a bottom face side positionable adjacent to the front of the wearer's hand; and a pair of spaced-apart and generally transversely-extending line segments formed upon the bottom face side of said at least one finger pocket.

14. The instructional hand glove of claim 13 wherein said at least one finger pocket comprises a plurality of finger pockets; and wherein said pair of spaced apart and generally transversely-extending line segments are formed upon the bottom face side of each finger pocket of said plurality of finger pockets, such that the line segments formed upon the plurality of finger pockets form two spaced apart and generally transversely-extending lines.

15. The instructional hand glove of claim 12 wherein said central glove piece further comprises a directional, arrowed segment formed upon the top face section of said central glove piece.

16. A pair of instructional hand gloves worn on a user's left and right hands to instruct the user in proper hand placement of the wearer's hands about a handle of an implement, said pair of instructional hand gloves comprising:

a left hand glove, said left hand glove including: a central glove piece having a palm section positionable adjacent to the palm of the wearer's hand and a top face section positionable adjacent to the back of the user's hand; a thumb pocket extending radially beyond said central glove piece, said thumb pocket positionable about a thumb of the wearer's hand; and curved left hand markings formed upon said thumb pocket including an arrowed marking extending longitudinally along said thumb pocket and a transversely-extending arcuate marking intersecting the arrowed marking, said curved left hand marking, for providing a visual indication to the wearer of the proper hand placement of the wearer's left hand about the handle of the staff-shaped implement; and a right hand glove, said right hand glove including: a central glove piece having a palm section positionable adjacent to the palm of the wearer's hand and a top face section positionable adjacent to the back of the wearer's hand; a thumb pocket extending radially beyond said central glove piece, said thumb pocket positionable about a thumb of the wearer's hand; and a curved right hand arrowed marking extending longitudinally along said thumb pocket adapted to align with the curved left hand markings, said curved right hand arrowed marking for providing a visual indication to the wearer of the proper hand placement of the wearer's right hand about the handle of the staff-shaped implement.

17. The pair of instructional hand gloves of claim 16, wherein said curved left hand markings are formed upon said left hand glove, and wherein said curved right hand arrowed marking is formed upon said right hand glove.

18. A method for providing instruction to a participant in an activity requiring the participant to grip a handle of an implement, said method comprising the steps of:

providing a hand glove having a thumb pocket positionable about a thumb of a hand of the participant;

forming curved markings upon the thumb pocket including an arrowed marking extending longitudinally along said thumb pocket and a transversely-extending arcuate marking intersecting the arrowed marking, said curved markings providing a visual indication of proper hand placement of the hand of the participant about the handle of the implement; and gripping the handle of the implement with the hand of the participant responsive to the visual indication of the proper hand placement provided by the curved markings formed upon the hand glove.

* * * * *